US005248226A

United States Patent [19]

Risi et al.

[11] Patent Number: 5,248,226

[45] Date of Patent: Sep. 28, 1993

[54] CONNECTOR FOR USE IN COMBINATION WITH BLOCKS FOR WALL STRUCTURES OR THE LIKE

[75] Inventors: Angelo Risi; Antonio Risi, both of Richmond Hill, Canada

[73] Assignee: Rothbury Investments Limited, Thornhill, Canada

[21] Appl. No.: 905,295

[22] Filed: Jun. 29, 1992

[30] Foreign Application Priority Data

Jun. 28, 1991 [CA] Canada ..... 2045953

[51] Int. Cl.[5] ..... E02D 17/20; E02D 29/02

[52] U.S. Cl. ..... 405/284; 52/286; 52/606; 405/272; 405/286

[58] Field of Search ..... 405/284, 285, 286, 262, 405/258; 52/437, 286, 285, 284, 589, 594, 605, 606, 442, 438, 567, 593

[56] References Cited

U.S. PATENT DOCUMENTS

| | | | |
|---|---|---|---|
| 811,534 | 2/1906 | Akers et al. | 52/286 |
| 979,913 | 12/1910 | Ault | 52/286 X |
| 2,303,559 | 12/1942 | Kinney | 52/606 X |
| 2,552,712 | 5/1951 | Ellis | 52/606 X |
| 3,005,282 | 10/1961 | Christiansen | 52/594 X |
| 3,012,377 | 12/1961 | Sunukjian | 52/286 |
| 3,680,277 | 8/1972 | Martin | 52/438 |
| 4,110,949 | 9/1978 | Cambiuzzi et al. | 52/606 X |
| 4,512,685 | 4/1985 | Hegle | 405/284 |
| 4,965,979 | 10/1990 | Larrivec et al. | 405/284 X |
| 5,044,834 | 9/1991 | Janopaul | 405/284 |
| 5,112,015 | 6/1992 | Shen | 405/286 X |

*Primary Examiner*—Dennis L. Taylor
*Attorney, Agent, or Firm*—Weldon F. Green

[57] ABSTRACT

This invention relates to improvements in retaining wall structures derived from a plurality of like structural blocks stacked end-to-end one upon the other in generally horizontally axially extending courses in overlapped wall defining relation. The blocks have a body portion with an axis terminating in opposed end surfaces, and are bounded by front and rear facings and by generally parallel upper and lower surfaces, with the upper and lower surfaces including therewithin respective opposed axially extending recess formations. More particularly, this invention relates to a connector for selectively positioning and interlocking against transverse displacement the blocks used in constructing the retaining wall structure. The connector includes a base portion of a configuration for the mating reception within one of the opposed recess formations of the blocks in at least one of three orientations, and a projection portion upstanding from the base portion of a configuration for the mating reception within the other of the opposed recess formations of the blocks, likewise in at least one of three orientations. The projection portion and the base portion of the connector are offset a selected extent so as to establish together with respective stacked blocks of the retaining wall structure at least three interlocked and overlapped wall defining dispositions.

24 Claims, 7 Drawing Sheets

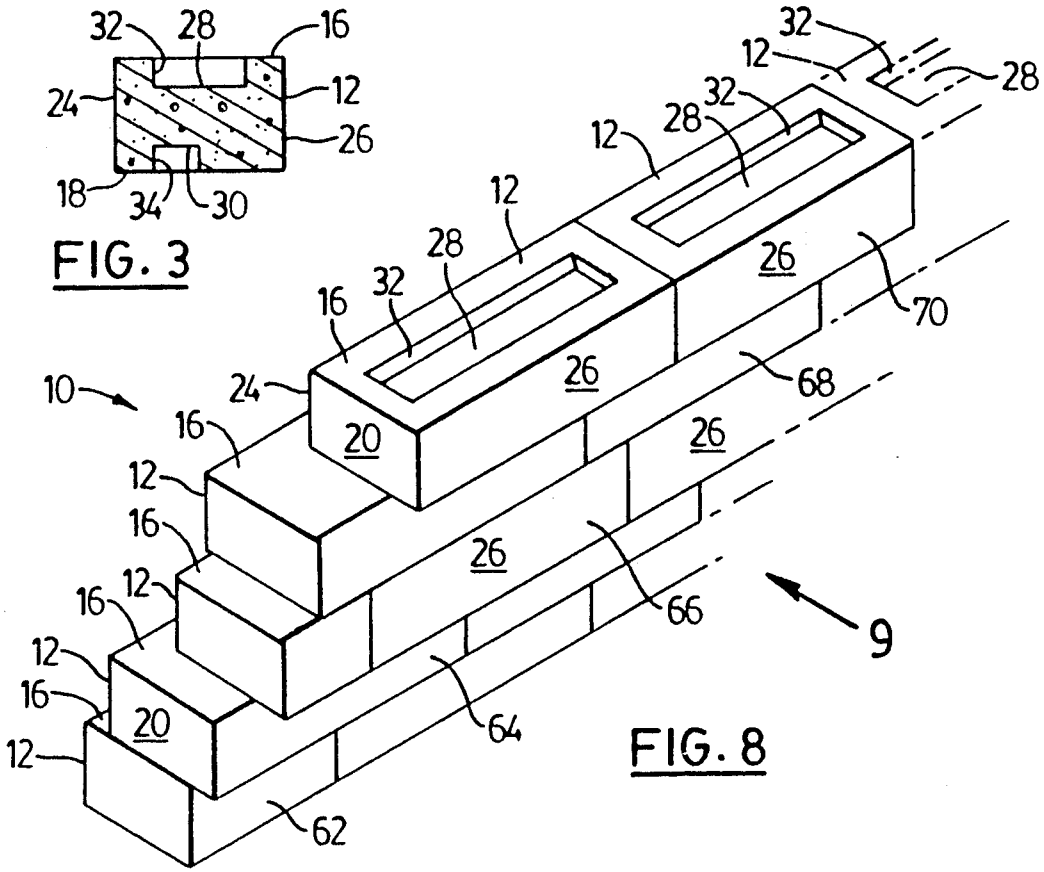
FIG. 8
FIG. 3
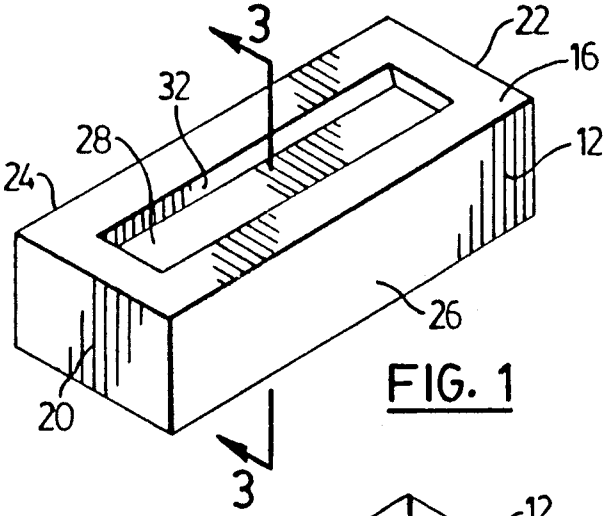
FIG. 1
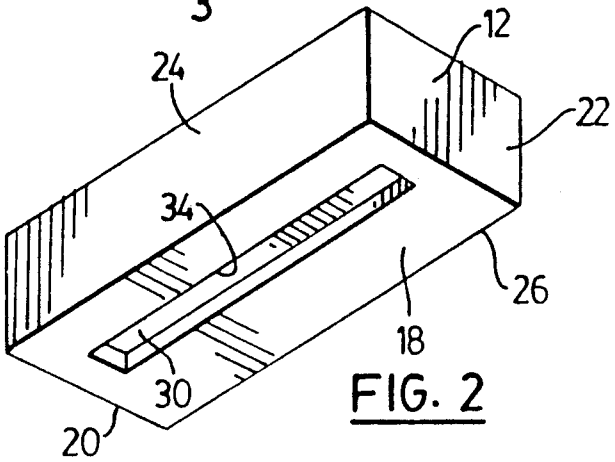
FIG. 2

CONNECTOR FOR USE IN COMBINATION WITH BLOCKS FOR WALL STRUCTURES OR THE LIKE

FIELD OF THE INVENTION

This invention relates to improvements in wall systems constructed from stackable interlockable structural blocks or facing wall units, preferably derived from precast concrete or the like, and, more particularly, to improvements in a connector for selectively positioning and interlocking the blocks in overlying relation.

More particularly, this invention relates to improvements in gravity retaining wall systems and a method for stacking the interlockable blocks in interlocked and overlapped relation in successive courses whereby one or more of several interlocked and overlapped block dispositions can be selected having regard to the criteria of a particular site as well as to aesthetics and those standards established by controlling building code regulations.

BACKGROUND OF THE INVENTION

Wall systems, and particularly retaining wall systems, which are derived from stackable interlocking modular precast concrete blocks that include facing wall units or stretchers, tie-back units or headers or combinations of same which go to make up cribbing units are well known.

One early gravity retaining wall system is disclosed by Canadian patent no. 941626 constructed from several like sets of blocks including facing wall units or stretchers and tie-back units or headers which have axially aligned matching projections and recesses so as to establish a strong sliding fit connection between inferior and superior courses one upon the other in which there is no setback and which are preferably, if not necessarily, mounted upon a rearwardly angled prepared footing.

Another proposal includes selecting appropriate dimensions for the modular blocks of the sets of units and adopting desired positioning of respective projections and recesses, as described by U.S. Pat. Nos. 4,490,075 and 4,815,897, which produces a precisely inclined facing wall or a vertically extending facing wall or a combination of inclined and vertically extending wall sections, all overlapped and interlocking in sliding fit in stacked relation without the use of mortar and all to be mounted upon a generally horizontally extending prepared footing.

The mortarless gravity retaining wall systems derived from the modular blocks that include facing wall units or stretchers and tie-back units or headers or the combinations thereof found in U.S. Pat. Nos. 4,490,075 and 4,815,897, utilize fixed offset projections and recesses for establishing a secure sliding fit interlock for respective modular blocks of the stacked superior and inferior courses and are limited to the degree of offset selected or the combination of such selected offset that produces two specific dispositions between superior and inferior blocks, namely, a specific angle of inclination and a generally vertical disposition of the facing wall, all in the manner prescribed by the United States patents above identified.

According to another proposal, U.S. Pat. No. 3,680,277, an arrangement for connecting stackable units such as concrete blocks or clay bricks together is disclosed wherein the blocks or bricks are provided with dovetail grooves or channels arranged in opposition. When like blocks are placed end-to-end with the respective opposed dovetailed grooves of such blocks adjacent to one another to form a keyway, a suitably dimensioned flexible springlike strip, folded upon itself, is fitted within the keyway so defined whereby adjacent blocks are secured together against separation.

OBJECT OF THE INVENTION

It is an object of this invention to provide a connector for selectively positioning and securely interlocking structural blocks or facing wall units stacked in overlying relation to construct a wall system.

It is a particular object of this invention to provide an improved gravity retaining wall system or structure derived from stackable structural blocks or facing wall units which can be selectively positioned and securely interlocked over a range of offsets as well as to extend vertically if required or desired, and thereby offer a greater degree of latitude both structurally and aesthetically in designing and installing such embankment reinforcing structures.

More particularly, it is an object of this invention to provide an improved retaining wall structure mounted upon a generally horizontally extending prepared footing or base that includes a facing wall derived from like structural blocks or facing wall units stacked one upon the other in horizontal courses in retaining wall defining relation with the facing wall blocks or units of an inferior course overlapped by the facing wall blocks or units of a superior course and selectively positionable in one of at least three interlocked wall defining dispositions.

FEATURES OF THE INVENTION

It is a feature of this invention to provide a connector for selective registration within opposed axially extending recess formations of like structural blocks or facing wall units, wherein such blocks are stacked end-to-end one upon the other in generally horizontally axially extending courses in overlapped wall defining relation, and with the connector providing for the relative positioning of such stacked blocks and the interlocking of same against displacement in a transverse direction.

It is a particular feature of this invention that the connector includes a base portion of a configuration for the mating reception within one of the opposed recess formations of the blocks in one of at least three orientations, and a projection portion upstanding from the base portion of a configuration for the mating reception within the other of the opposed recess formations of the blocks likewise in one of at least three orientations.

Moreover, it is a feature of this invention that the projection portion and the base portion are offset a selected extent so as to establish together with respective stacked blocks at least three interlocked and overlapped wall defining dispositions.

It is a further feature of this invention that the base portion of the connector be of a generally parallelogrammatical configuration. Moreover, the base portion has a perimetral extent including at least three facings, and in the preferred embodiment has a perimetral extent including four facings. In an alternative embodiment of the invention the base portion of the connector is of a generally cylindrical configuration.

It is also a feature of this invention that the projection portion of the connector be of a generally parallelogrammatical configuration. As with the base portion.

the projection portion has a perimetral extent including at least three facings, and in the preferred embodiment has a perimetral extent including four facings. Again, in an alternative embodiment of the invention the projection portion of the connector is of a generally cylindrical configuration.

It is a further feature of this invention that the projection portion of the connector has a perimetral extent less than the perimetral extent of the base portion.

It is yet a further feature of this invention that the projection portion of the connector be offset from the base portion so that at least one facing of its perimetral extent is flush with at least one facing of the perimetral extent of the base portion.

More particularly, it is a feature of this invention to provide a retaining wall structure that includes a plurality of like structural blocks stacked end-to-end one upon the other in generally horizontally axially extending courses in overlapped wall defining relation and selectively positioned and interlocked against displacement in a transverse direction by a plurality of connectors. Such blocks of the invention have a body portion with an axis terminating in opposed end surfaces and bounded by front and rear facings and by generally parallel upper and lower surfaces and with the upper and lower surfaces including therewithin respective opposed axially extending recess formations for the mating reception therewithin of the connectors.

It is a further feature of such block to have the axially extending recess formations within the upper and lower surfaces to have respective opposed axially extending edge formations aligned in overlying relation.

Finally, it is a feature of this invention to provide a method for constructing a retaining wall structure derived from a plurality of like structural blocks selectively positioned and interlocked against displacement in a transverse direction by a plurality of like connectors, which method comprises the steps of:

a) excavating the soil to a selected depth and providing a base suitable to support the retaining wall;
b) laying upon the base a course of like structural blocks used in constructing the retaining wall;
c) selectively positioning in one of at least three orientations within axially extending recess formations provided in the upper surfaces of such structural blocks the base portions of the connectors with the projection portions presented upwardly;
d) laying upon the blocks of the lower course in contiguous overlapped relation a superior course of like structural blocks with the projection portions of the connectors selectively positioned in one of at least three orientations within respective axially extending recess formations provided in the lower surface of the structural blocks in the superior course; and
e) repeating the aforementioned steps in sequence so as to establish a retaining wall structure with selected offsets to the vertical as desired.

DESCRIPTION OF THE INVENTION

These and other features of the invention are outlined in following description to be read in conjunction with the sheets of drawings in which:

FIG. 1 is a perspective view of the structural block or facing wall unit of the invention illustrating the recess provided in the upper surface thereof for receiving therein, in the preferred embodiment, the base portion of the connector unit;

FIG. 2 is a perspective view of the structural block or facing wall unit shown in FIG. 1 and illustrating the recess in the lower surface thereof for receiving therein, in the preferred embodiment, the projection portion of the connector;

FIG. 3 is a cross-sectional view of the structural block or facing wall unit taken along the lines 3—3 of FIG. 1;

Figure 4:
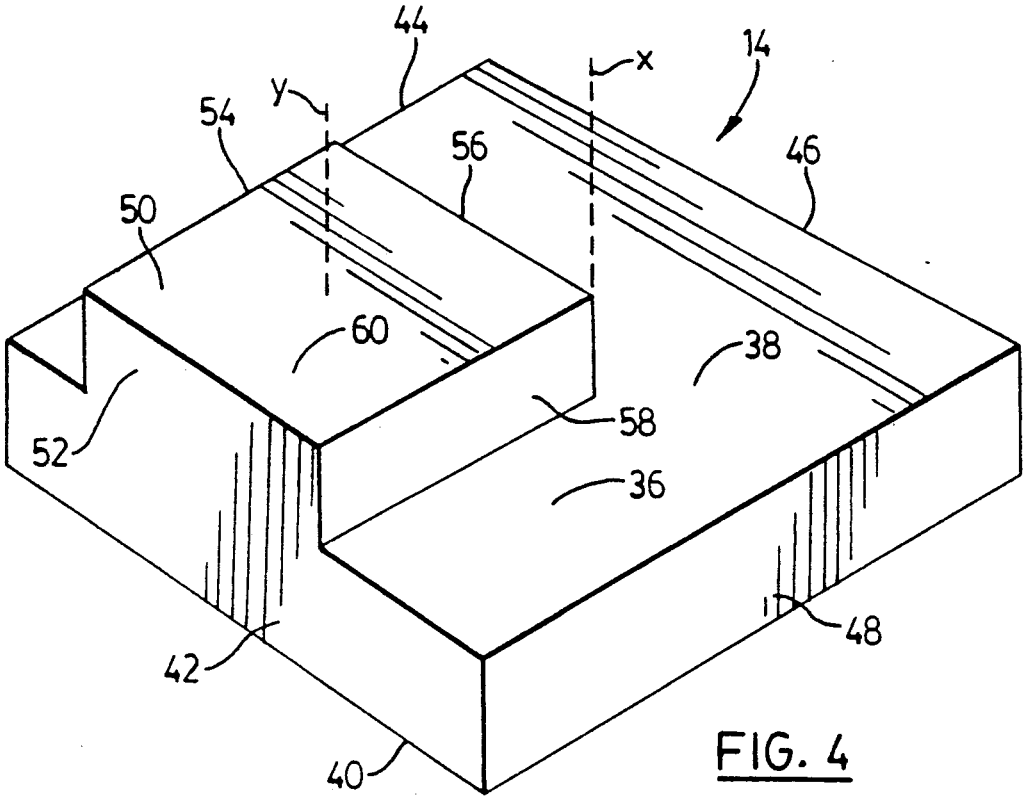
FIG. 4 is a perspective view of the connector of the invention.
Figure 5:
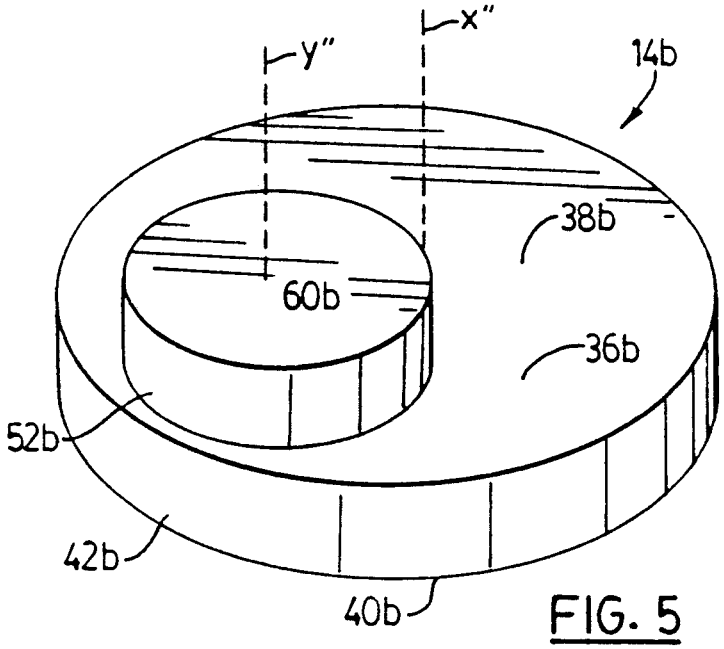
Figure 4A:
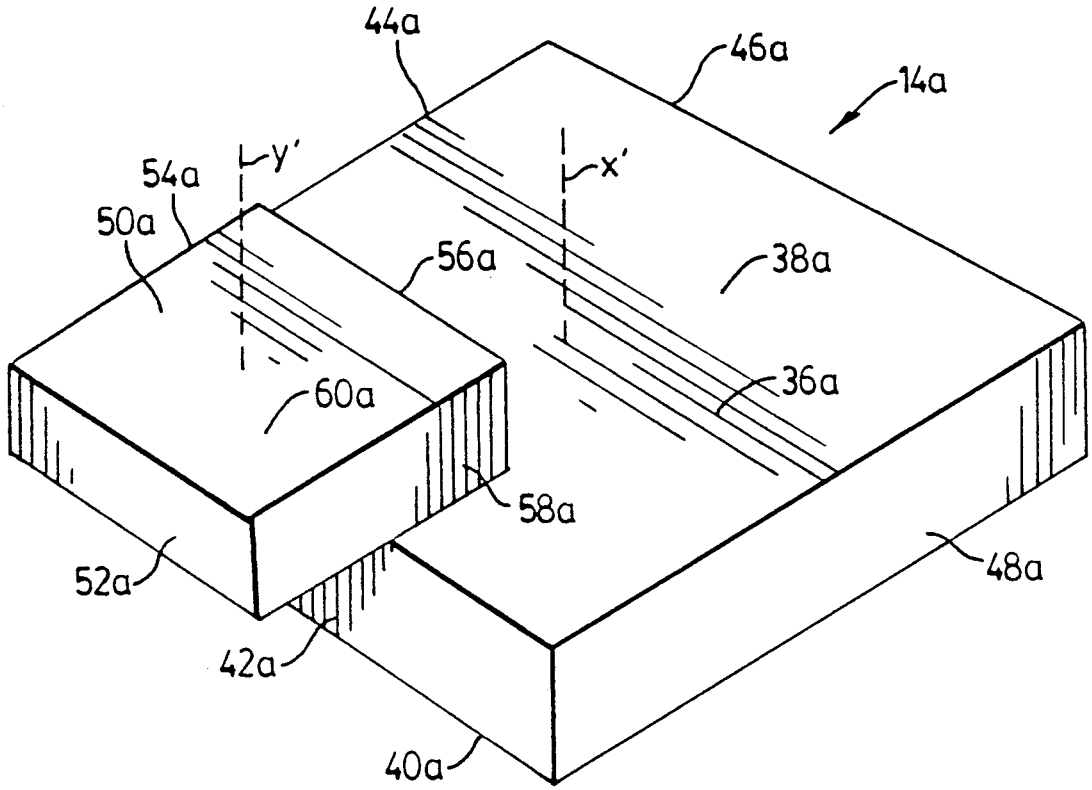
Figure 6:
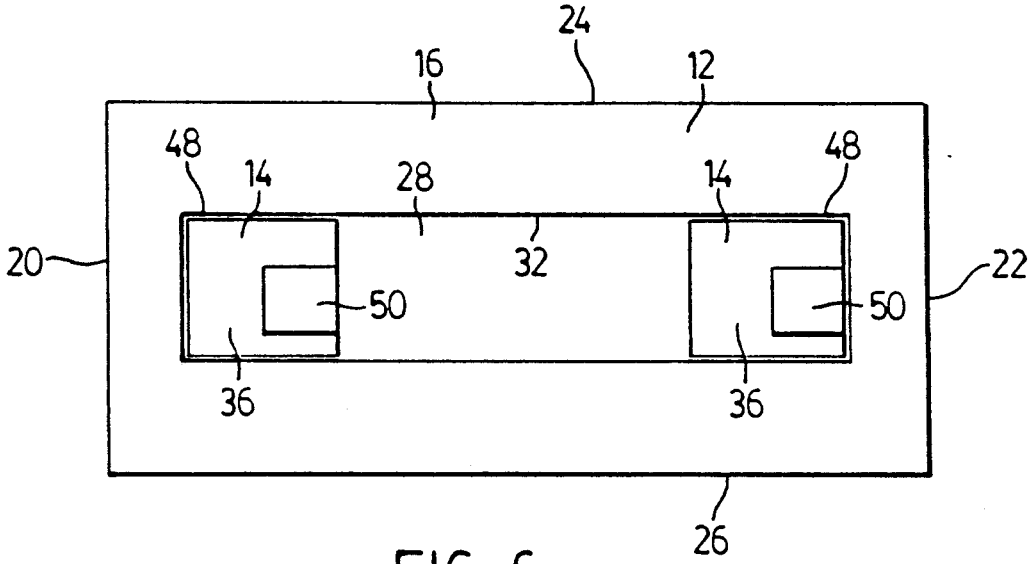
Figure 7:
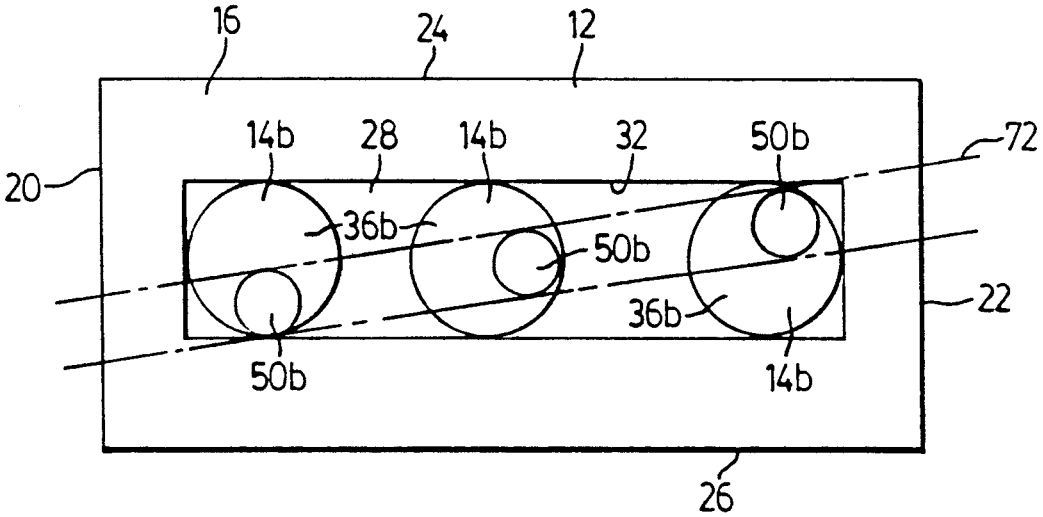
Figure 9:
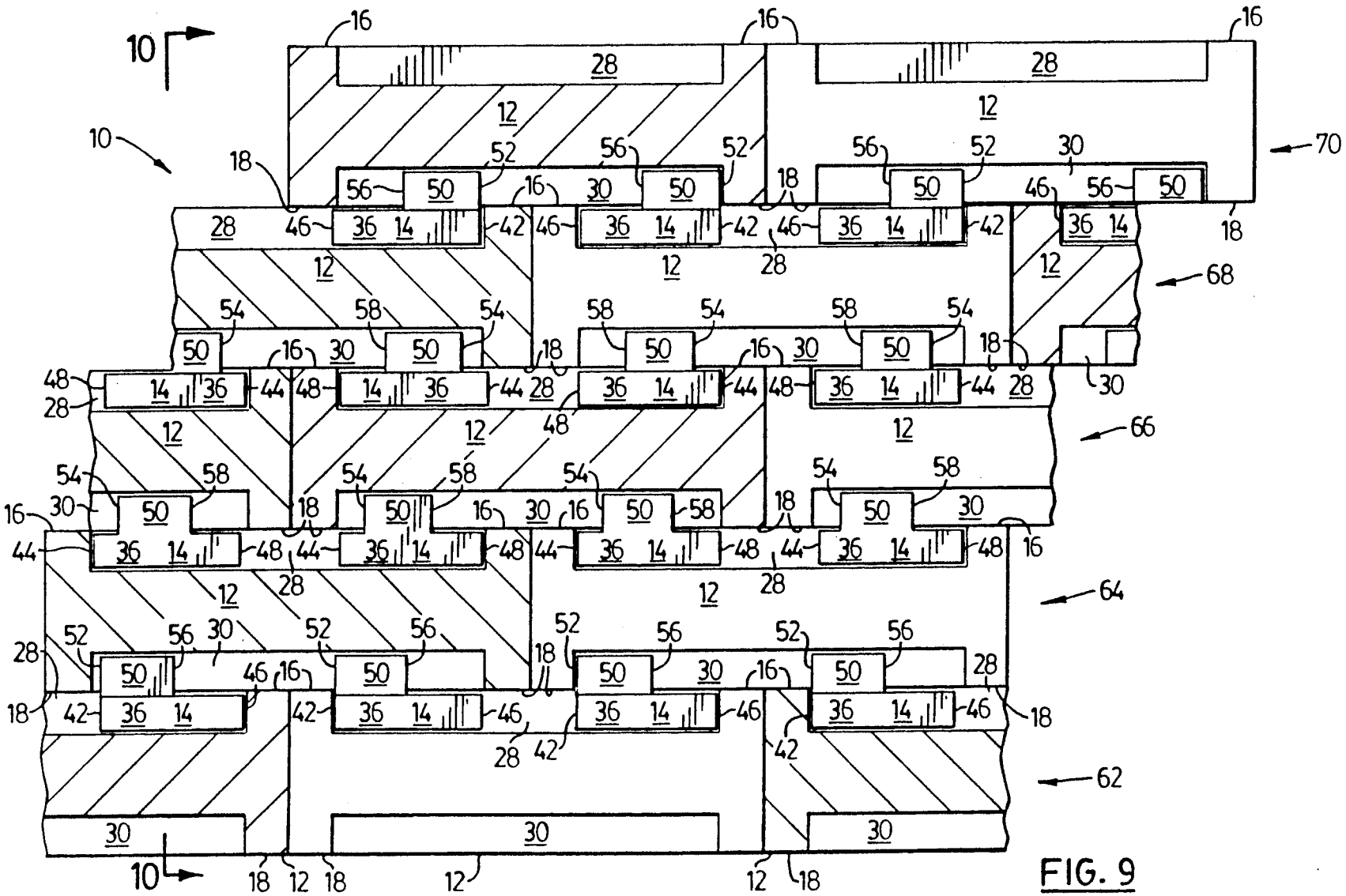
Figure 10:
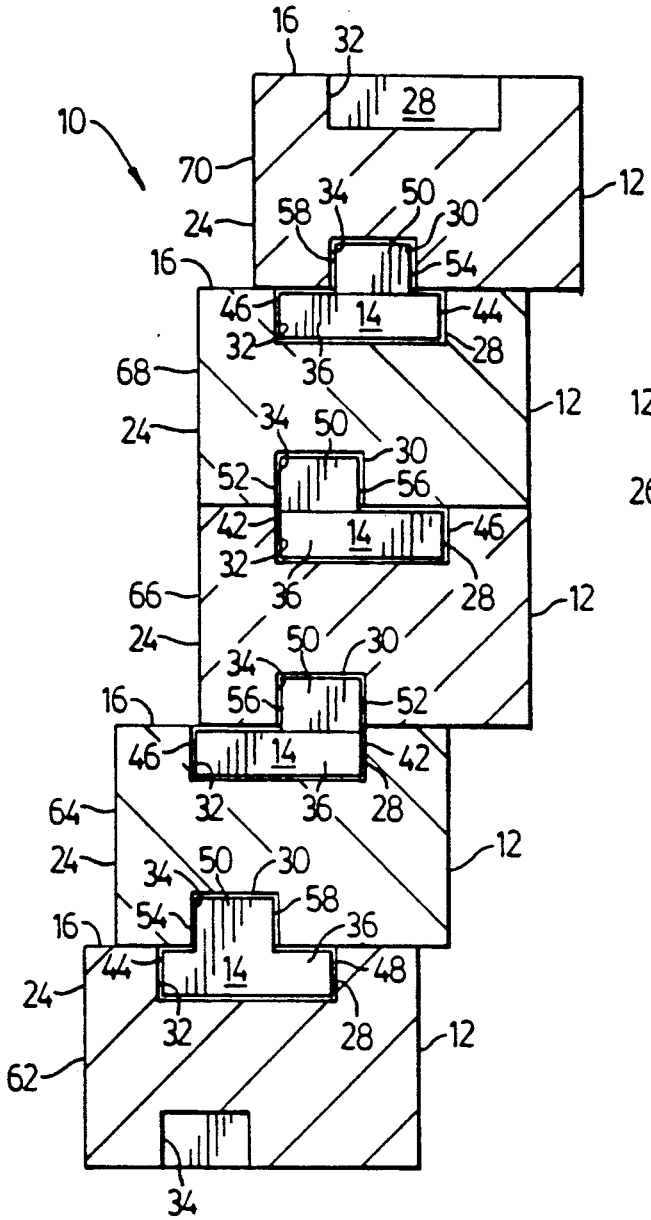
Figure 11:
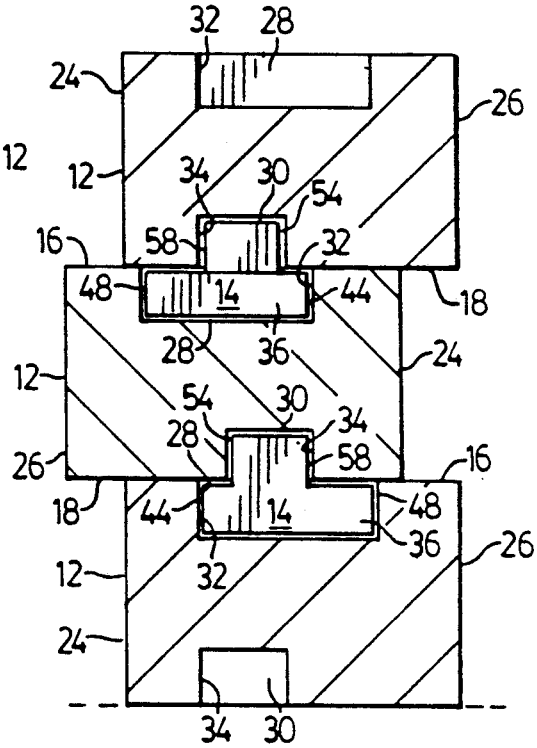
Figure 13:
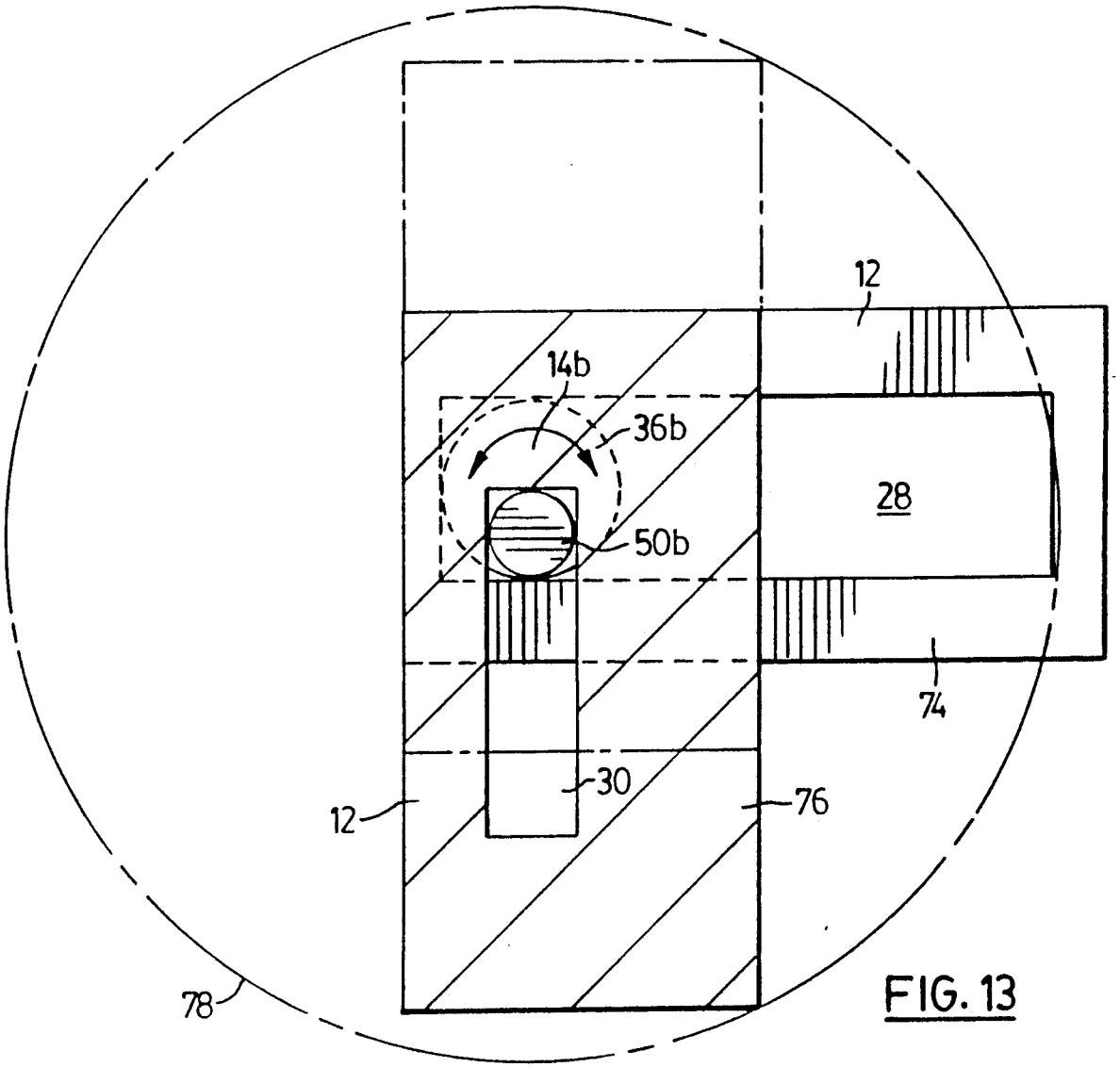
Figure 12:
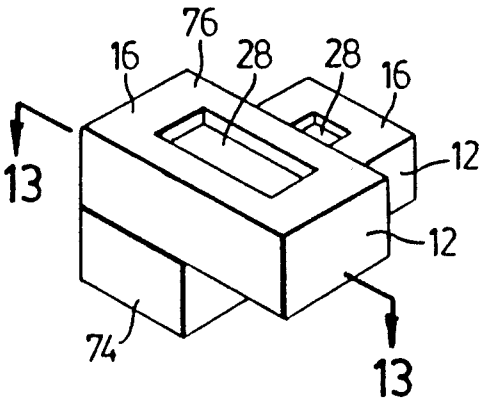

FIG. 4*a* is a perspective view of a second embodiment of the connector;

FIG. 5 is a perspective view of a third embodiment of the connector;

FIG. 6 is a top elevational view of the structural block or facing wall unit illustrating a plurality of connectors of the invention from FIG. 4 within the recess of the upper surface thereof;

FIG. 7 is a top elevational view of the structural block or facing wall unit illustrating a plurality of connectors of the third embodiment of the invention from FIG. 5 within the recess of the upper surface thereof;

FIG. 8 is a perspective view of the retaining wall of the invention with the structural blocks or facing wall units stacked in interlocked, overlapping horizontal courses with each course offset in relation to the next adjacent course and illustrating various setbacks that can be achieved including verticality using the connector of the invention;

FIG. 9 is a rear elevational view of the retaining wall taken in the direction of line 9 of FIG. 8;

FIG. 10 is a side cross-sectional view of the retaining wall taken along lines 10—10 of FIG. 9;

FIG. 11 is a side elevational view of an alternative retaining wall illustrating a structural block or facing wall unit extending forwardly of the wall over a part thereof;

FIG. 12 is a perspective view of structural blocks or facing wall units orientated at right angles with respect to one another; and FIG. 13 is a top elevational cross-sectional view taken along lines 13—13 of FIG. 12 illustrating one use of the connector of FIG. 5 of the invention.

The improved retaining wall systems of the invention is best illustrated by facing wall 10, as shown in FIG. 8 of the drawings. Retaining wall 10 is derived from a plurality of structural blocks or facing wall units 12 stacked in overlapping relation in horizontal courses. As can be seen from FIG. 8 blocks 12 are arranged in horizontal courses in wall defining relation such that the wall extends upwardly to the vertical over a selected range of offsets or setbacks, as well as to extend vertically if required or desired; the selection of which is governed by the selective placement of connector 14 as will hereinafter be detailed.

Blocks 12 have a main body which is preferably generally parallelegramatical in configuration and is bounded by generally parallel upper and lower surfaces 16, 18, respectively, a longitudinal axis terminating in respective opposed end surfaces 20, 22, and front and rear facings 24, 26, respectively. Although in the preferred embodiment blocks 12 feature generally parallel surfaces and facings, as illustrated in FIGS. 1 to 3, it is understood that the blocks are not limited to such configuration; all that is required is that blocks 12 be of a configuration to enable like blocks to be stacked one upon the other in overlying wall defining relation and, therefore, respective upper and lower surfaces 16, 18, must be of a complimentary matching construction.

Facing wall units or structural blocks 12 include in upper surface 16 a cavity or recess 28 for receiving, in the preferred embodiment, the base portion of connector 14, as will hereinafter be explained. Lower surface 18 of blocks 12 includes therein a similar cavity or recess 30 for receiving, in the preferred embodiment, the projection portion of connector 14, as will hereinafter be explained. In the preferred embodiment of the invention recess formations 28, 30 in upper and lower surfaces 16, 18, respectively, of blocks 12 extend axially longitudinally of the block. These recess formations can be closed-ended, as illustrated, or can extend fully from end surface 20 to end surface 22 of block 12, so as to be open-ended, not illustrated, or can be a plurality or series of separate recess formations extending axially longitudinally of the block, again not illustrated.

In the preferred embodiment blocks 12 are preferably derived from concrete and have dimensions of the order of 8" deep, 12" wide, and 24" in length. It can be appreciated, however, that facing wall units or structural blocks 12 of various dimensions and configurations can be constructed as required for use in retaining wall systems or facing walls and, particularly, provide an aesthetically pleasing wall without departing from the spirit of the invention described herein and claimed, yet meet governmental regulations concerning safety.

Recess 28 in upper surface 16 of block 12 extends axially, in the preferred embodiment, at least 18" in length. The width of recess 28 in upper surface 16 of block 12 is, in the preferred embodiment, of the order of 6"; the depth is of the order of 1". The dimensions of recess 28, and particularly the depth and width, are such that the base portion of connector 14 will be accommodated therewithin, as will hereinafter be described.

Recess 30 provided within lower surface 18 of block 12, in the preferred embodiment, extends longitudinally axially of the block a similar distance to recess 28 in upper surface 16 of block 12, and is of the order of 18" in length. The width of recess 30 in lower surface 18 of block 12 is, in the preferred embodiment, of the order of 3", with the depth of such recess of the order of 1". Again, the dimensions of recess 30, and particularly the depth and width, are such that the projection portion of connector 14 will be accommodated therewithin, as will hereinafter be described.

FIG. 3 specifically shows that the front to back extent of recess 30 in lower surface 18 is less than the front to back extent of recess 28 in upper surface 16 of block 12. In the preferred embodiment recess 28 in upper surface 16 of block 12 has one of its axially extending sides or edge formations 32 overlying and in alignment with corresponding axially extending side or edge formation 34 of recess 30 in lower surface 18 of block 12. This aligning of respective sides 32, 34, of respective recesses 28, 30, of block 12 assists in selecting the various setbacks or offsets to the vertical, or to allow vertical alignment, of a resulting facing wall or retaining wall constructed as required or desired and as will hereinafter be explained. It should be appreciated, however, that the alignment of sides 32, 34, respectively, of recesses 28, 30, respectively, is preferable to facilitate the ease of determining the desired setback or offset, but is not limiting to the invention, and indeed, various front-to-back dispositions of recesses 28, 30, will result in a wide selection of setbacks or offsetness to the vertical, as desired, and as will hereinafter become apparent.

Further, it is to be appreciated that these are preferred dimensions for the embodiment disclosed; the recess formation in the upper surface of block 12 could be provided in the lower surface, and the lower recess formation as currently disclosed could be provided in the upper surface of such block, if desired—the connector unit would then, in effect, be selectively positioned "upside-down" in these recess formations.

Connector 14 is best illustrated in FIG. 4, and includes a base portion 36 of substantially parallelegramatical configuration, and, in the preferred embodiment, includes parallel upper and lower surfaces 38, 40, respectively, parallel opposed end or side surfaces 42, 46, and 44, 48, respectively, forming, as preferred and illustrated, a base portion 36 having perimetral extent substantially square in configuration in plan view.

The dimensioning of base portion 36 of connector 14 is such so as to allow same to fit in mating reception or snugly within recess 28 in upper surface 16 of block 12, and particularly so that there is no displacement of connector 14 in the front-to-rear direction of the block, or, more particularly, a transverse direction to axially extending recess 28. Accordingly, in the preferred embodiment, base portion 36 of connector 14 is 6" by 6" square by 1" deep: compatible with the width and depth dimensions of recess 28 of block 12. The preferred material of construction is concrete, however, other materials can be used which are strong in nature, yet resist corrosion and able to withstand varying outside environmental conditions, particularly when the connector is used in combination with structural blocks or facing wall units for constructing retaining wall systems.

Upstanding from base portion 36 of connector 14 is projection portion 50 including, in the preferred embodiment, parallel opposed end or side surfaces 52, 56, and 54, 58, respectively, and forming, as preferred and illustrated, a projection portion 50 having a perimetral extent substantially square in configuration in plan view. Upper surface 60 of projection portion 50 of connector 14 is, in the preferred embodiment, parallel in relation to upper and lower surfaces 38, 40, respectively, of base portion 36.

Projection portion 50 of connector 14 is similarly dimensioned to base portion 36 so as to fit in mating reception or snugly within respective recess 30 in lower surface 18 of block 12, and, again, particularly so that there is no displacement in the front-to-rear direction of the block, or, more particularly, a transverse direction to axially extending recess 30. Accordingly, in the preferred embodiment, projection portion 50 of connector 14 is 3" by 3" square by 1" deep: compatible with the width and depth dimensions of recess 30 of block 12.

In order that the various setbacks or offsets to the vertical, including one disposed vertical, can be selected for a facing or retaining wall to be constructed when like blocks 12 are stacked one upon the other in overlapping wall defining relation, as will hereinafter be described, it is desired that projection portion 50 of connector 14, have its central axis y offset in relation to a central axis x of base portion 36 of connector 14, as best illustrated in FIG. 4. Particularly, projection portion 50 of connector 14, in the preferred embodiment, has side surface 54 offset from side surface 44 of base portion 36 by a distance of 1", side surface 56 offset from side surface 46 by a distance of 2", side surface 58 offset from side surface 48 by a distance of 3", and has side surface 52 in vertical alignment or flush with side surface 42 of base portion 36.

A second embodiment of a connector of the invention is illustrated in FIG. 4*a* wherein like reference characters designate like parts except are followed with the designation a, as in connector 14*a*.

The connector 14*a* illustrated in FIG. 4*a* features a projection 50*a* extending beyond side 42*a* of base portion 36*a*. In particular, in the embodiment illustrated, side 54*a* is offset from side 44*a* by a distance of the order of 1", side 56*a* is offset from side 46*a* by a distance of the order of 4½", side 58*a* is offset from side 48*a* a distance of 2", and side 52*a* extends beyond side 42*a* of base portion 36*a* a distance of the order of 1½".

As will become apparent hereinafter in the description for the retaining wall, by providing a connector with a projection portion so offset from the base portion an accentuated offsetness in at least one direction can be imported to the resulting wall structure or facing wall as desired.

FIG. 5 illustrates a third embodiment of the connector wherein like reference characters designate like parts except are followed with the designation b, as in connector 14*b*.

In particular, connector 14*b* includes base portion 36*b* and projection portion 50*b* having perimetral extents substantially circular in configuration in plan view. In dimensioning connector 14*b* so that it fits within recesses 28, 30 provided in upper and lower surfaces 16, 18, respectively, of block 12 the diameter of base portion 36*b* is of the order of 6", while the diameter of projection portion 50*b* is of the order of 3". Central axis y" of projection portion 50*b* of connector 14*b* is offset from central axis x" of base portion 36*b* such that a portion of perimetral surface 52*b* of projection portion 50*b* is in vertical alignment or flush with a portion of perimetral surface 42*b* of base portion 36*b*, as best illustrated in FIG. 5.

It can be appreciated, however, that a connector such as connector 14*b* could be designed having the projection portion 50*b* extending beyond base portion 36*b* in a manner similar to that illustrated for connector 14*a* in FIG. 4*a*.

Further, although the connectors disclosed above in FIGS. 4, 4*a*, and 5, are preferred in that they readily facilitate selection of the requisite or desired setback or offset in the retaining wall to be constructed, as will hereinafter be described, it is to be understood that connectors of various configurations can be constructed without departing from the spirit of the invention.

Retaining Wall

Retaining wall or facing wall 10, as best illustrated in FIG. 8, is derived from a plurality of like modular facing wall units or structural blocks 12 stacked end-to-end one upon the other in generally horizontally axially extending courses in overlapped wall defining relation and selectively positioned and interlocked against displacement in at least a front to rear direction or, more particularly, a transverse direction to the axis, by a plurality of connector 14.

In particular, retaining wall 10 features a number of setbacks or offsetness to the vertical, including one disposition extending generally vertically; the required or desired setback or offsetness, including the substantially vertical disposition is achieved through the dimensioning of recesses 28, 30, in upper and lower surfaces 16, 18, respectively, of blocks 12 and the alignment of respective edges 32, 34, the offsetness of projection portion 50 from base portion 36 of connector 14, or, as particularly illustrated in the figures for the preferred embodiment of this invention, through a combination of the dimensioning of recesses 28, 30, in upper and lower surfaces 16, 18 and the alignment of respective edges 32, 34, together with the selective placement of a connector therein featuring an offset projection portion 50 to a base portion 36.

To select a desired offsetness or setback, base portion 36 of connector 14 is selectively positioned within recess 28 of upper surface 16 of facing wall unit or block 12 in one of four orientations, as best illustrated in FIG. 10.

In particular, by placing connector 14 within recess 28 of upper surface 16 of blocks 12 in lower course 62 with side 44 of base portion 36 abutting against side 32 of recess 28, then, due to the alignment of sides 32, 34, of recesses 28, 30, respectively, projection portion 50 of connector 14 extends into recess 30 of a lower surface 18 of like blocks 12 presented thereto from course 64, and with its side 54 abutting against side 34 of recess 30 of such blocks, so as to impart to the overlapping blocks a setback equal to the offsetness of side 54 of projection portion 50 of connector 14 to side 44 of base portion 36, namely 1".

As can be seen from FIG. 10, when sides 32, 34, of recesses 28, 30, respectively, of blocks 12 are aligned, then by placing one block upon a lower block the connector positions the overlying blocks such that they are setback from the lower blocks a distance equal to the offsetness of side surfaces or faces 52, 54, 56, 58 of projection portion 50 to side surfaces or faces 42, 44, 46, 48, respectively, of base portion 36 of connector 14.

Accordingly, should one desire a setback of 3" for a given course, for example course 66 in FIG. 8, then connector 14 is positioned within recess 28 of upper surface 16 of the block with side face or surface 46 of base portion 36 abutting side 32 of recess 28 in upper surface 16 of the block, as illustrated in FIG. 10, and then apply block 12 in overlapped wall defining relation, and particularly with side face or surface 56 of projection portion 50 abutting side 34 of recess 30 in lower surface 18 of the block so presented.

The fourth course 68 of blocks 12 illustrated in FIGS. 8 and 10 is disposed so that it extends substantially vertically. This is achieved by positioning connector 14 so that aligned side surface or face 52 of projection portion 50 and side surface or face 42 of base portion 36 abut against aligned sides 32, 34, of recesses 28, 30, respectively, of respective upper and lower blocks from courses 68, 66, as illustrated.

Finally, the fifth course 70 of blocks 12 illustrated in FIG. 8 discloses a setback of 2". This is achieved in a similar manner as described above for the previous courses with side surface or face 58 of projection portion 50 of connector 14 abutting against side 32 of recess 28 of block 12, and with side surface or face 48 of base portion 36 of such connector abutting against side 34 of recess 30 of block 12 presented thereto from course 70 above.

It can be appreciated that when constructing a stable retaining wall the facing wall units or structural blocks are stacked one upon the other in horizontal overlapping courses, as particularly illustrated in FIGS. 8 and 9. To achieve a uniform setback over a given course the base portions of the connectors are positioned within the upper recess formations of the blocks with their projection portion oriented in the same way, as best illustrated in FIG. 6, and in FIG. 9 of the cut-a-way view of the retaining wall illustrated in FIG. 8.

Should, however, a selected block require or it is desired to be angularly disposed in relation to a block therebelow, then connector 14*b* can be used by selectively positioning base portions 36*b* of connectors 14*b* so that projection portions 50*b* are oriented to define longitudinal axis 72 which is at an angle to the longitudinal axis of the lower block, as illustrated in FIG. 7. An upper course block can be positioned by aligning recess 30 in its lower surface 18 with longitudinal axis 72 defined by the orientation of the projection portions of connectors 14*b* within recess 28 of the block of the lower course. The benefit of this angular offsetness or setback can be appreciated in, for example, the construction of a curved stairwell, or in the construction of a terraced landscape featuring curved retaining walls or facing walls.

It can also be appreciated that by constructing a retaining wall utilizing connector 14*b*, then a retaining wall or facing wall can be constructed featuring an infinite variety of setbacks or offsetness.

By using connector 14, as illustrated in FIG. 4, a great variety of offsets or setbacks can also be achieved by constructing such connectors with the projection portions offset from the base portions such as, but not limited to, the embodiment illustrated in FIG. 4*a*.

Further degrees of setbacks or offsets can be achieved by varying the alignment between the side surfaces 32, 34, of respective recesses 28, 30, of upper and lower surfaces 16, 18, respectively, of blocks 12.

The ease by which retaining wall structures or facing walls of various angular orientations can be constructed using connector 14*b* as illustrated in FIG. 5 can particularly be appreciated having regard to the stacking of successive courses of blocks as illustrated in FIGS. 12 and 13.

FIG. 12 discloses a corner construction readily achieved utilizing the connectors 14*b*. The unique advantage of this connector, however, does not reside so much in a right angle that can be constructed, which could be achieved through use of a connector illustrated in FIG. 4, but particularly by the wide variety of dispositions of the upper block, and as illustrated by dotted lines 78 in FIG. 13. In particular an upper block can be orientated at a wide variety of angles to the lower block so that a variety of angular corners can be achieved.

It can also be appreciated from FIG. 13 that in spite of all these angular orientations the upper block is always interlocked against displacements in a transverse direction to its longitudinal axis by the connector, thus adding stability to the corner structure.

Whereas the preferred embodiments of the connector for selectively positioning and interlocking against transverse displacement a plurality of structural blocks so as to establish a sound and enduring retaining wall structure featuring a variety of offsets or setbacks and at a variety of angular orientations so as to create curved retaining wall structures has been described and illustrated, persons skilled in the art may adopt other alternatives embodying the invention without departing from the spirit or scope of the invention as defined in the appended claims.

What I claim is:

1. In a connector for selective registration within opposed axially extending recess formations presented by like structural blocks stacked end-to-end and one upon the other in generally horizontally axially extending courses in overlapped wall defining relation for the relative positioning of adjacent courses of such stacked blocks and the interlocking of same against displacement in a transverse direction, said connector including a base portion having an upstanding axis and bounded by side facings of a configuration for the mating reception in one of at least three orientations within one of the opposed recess formations presented by like blocks of a given course, and a projection portion upstanding from said base portion and having an upstanding axis and bounded by side facings of a configuration for the mating reception in one of at least three orientations within one of the opposed recess formations presented by like blocks of an adjacent course, said upstanding axis of said projection portion and said upstanding axis of said base portion being offset a selected extent with respect to one another so as to establish when said projection portion and said base portion are in mating reception within said respective recess formations of adjacent courses of like blocks at least three interlocked and overlapped wall defining dispositions.

2. A connector according to claim 1 wherein said base portion is of a generally parallelogrammatical configuration.

3. A connector according to claim 2 wherein said base portion has a perimetral extent including at least three facings.

4. A connector according to claim 2 wherein said base portion has a perimetral extent including four facings.

5. A connector according to claim 1 wherein said base portion is of a generally cylindrical configuration.

6. A connector according to claims 1, 2, 3, or 4, wherein said projection portion is of a generally parallelogrammatical configuration.

7. A connector according to claim 6 wherein said projection portion has a perimetral extent including at least three facings.

8. A connector according to claim 6 wherein said projection portion has a perimetral extent including four facings.

9. A connector according to claim 5 wherein said projection portion is of a generally cylindrical configuration.

10. A connector according to claims 7, 8, or 9, wherein said projection portion has a perimetral extent less than the perimetral extent of said base portion.

11. A connector according to claims 7, 8, or 9, wherein said projection portion is offset from said base portion so that at least one facing of its perimetral extent is flush with at least one facing of the perimetral extent of said base portion.

12. In a retaining wall structure that includes a plurality of like structural blocks stacked end-to-end one upon the other in generally horizontally axially extending courses in overlapped wall defining relation and with said adjacent courses selectively positioned and interlocked against displacement in a transverse direction by a plurality of connectors, said blocks having a body portion with an axis terminating in opposed end surfaces and bound by front and rear facings and by generally parallel upper and lower surfaces and with said upper and lower surfaces including therewithin respective opposed axially extending recess formations, and said connector including a base portion having an upstanding axis and bounded by side facings of a configuration for the mating reception in one of at least three orientations within one of the opposed recess formations presented by like blocks of a given course, and a projection portion upstanding from said base portion and having an upstanding axis and bounded by side facings of a configuration for the mating reception in one of at least three orientations within one of the opposed recess formations presented by like blocks of an adjacent course, said upstanding axis of said projection portion and said upstanding axis of said portion being offset a selected extent with respect to one another so as to establish when said projection portion and said base portion are in mating reception within said respective recess formations of adjacent courses of like blocks at least three interlocked and overlapped wall defining dispositions.

13. A retaining wall according to claim 12 wherein said opposed axially extending recess formations within the upper and lower surfaces of said block have respective opposed axially extending edge formations aligned in overlying relation.

14. A retaining wall structure according to claim 12 wherein said base portion of said connector is of a generally parallelogrammatical configuration.

15. A retaining wall structure according to claim 14 wherein said base portion of said connector has a perimetral extent including at least three facings.

16. A retaining wall structure according to claim 14 wherein said base portion of said connector has a perimetral extent including four facings.

17. A retaining wall structure according to claim 12 wherein said base portion of said connector is of a generally cylindrical configuration.

18. A retaining wall structure according to claims 12, 14, 15, or 16, wherein said projection portion of said connector is of a generally parallelogrammatical configuration.

19. A retaining wall structure according to claim 18 wherein said projection portion of said connector has a perimetral extent including at least three facings.

20. A retaining wall structure according to claim 18 wherein said projection portion of said connector has a perimetral extent including four facings.

21. A retaining wall structure according to claim 17 wherein said projection portion of said connector is of a generally cylindrical configuration.

22. A retaining wall structure according to claims 19, 20 or 21, wherein said projection portion of said connector has a perimetral extent less than the perimetral extent of said base portion of said connector.

23. A retaining wall structure according to claims 19, 20, or 21, wherein said projection portion of said connector is offset from said base portion so that at least one facing of its perimetral extent is flush with at least one facing of the perimetral extent of said base portion.

24. A method for constructing a retaining wall structure derived from a plurality of like structural blocks to be stacked in end-to-end relation and one upon the other in generally horizontally axially extending courses in overlapped wall defining relation and with like blocks of adjacent courses selectively positioned and interlocked against displacement in a transverse direction by a plurality of like connectors, which method comprises the steps of:

(a) excavating the soil to a selected depth and providing a base suitable to support the retaining wall;

(b) laying upon the base a course of like structural blocks used in constructing the retaining wall;

(c) selectively positioning in one of at least three orientations within axially extending recess formations provided in the upper surfaces of said structural blocks the base portions of said connectors with the projection portions presented upwardly;

(d) laying upon the blocks of the lower course in contiguous overlapped relation a superior course of like structural blocks with said projection portions of said connectors selectively positioned in one of at least three orientations within respective axially extending recess formations provided in the lower surface of said structural blocks in said superior course; and (e) repeating the aforementioned steps in sequence so as to establish a retaining wall structure with selected offsets to the vertical as desired.

* * * * *